United States Patent [19]

O'Keefe

[11] Patent Number: 4,751,289

[45] Date of Patent: Jun. 14, 1988

[54] HEXANITROTETRACHLOROAZOBENZENE AND METHOD OF PREPARATION

[75] Inventor: David M. O'Keefe, Mansfield, Tex.

[73] Assignee: Texas Explosives Co. Inc., Mansfield, Tex.

[21] Appl. No.: 946,859

[22] Filed: Dec. 29, 1986

[51] Int. Cl.[4] ..... C06B 25/04; C07C 107/06; C09B 43/04

[52] U.S. Cl. ..... 534/843; 149/105; 534/601

[58] Field of Search ..... 534/843, 601

[56] References Cited

U.S. PATENT DOCUMENTS

| | | | |
|---|---|---|---|
| 116,351 | 8/1980 | Atkins et al. | 534/843 X |
| 3,461,112 | 8/1969 | Sickman et al. | 534/843 X |

OTHER PUBLICATIONS

Flurscheim et al. Journal of Chemical Society 3041 (1928).

Nielsen et al., I Journal of Organic Chemistry, vol. 44, 1181 (1979).

Nielsen et al., II, Journal of Organic Chemistry, vol. 45, 2341 (1980).

Atkins et al., I, Journal of Organic Chemistry, vol. 49, 503 (1984).

Wheeler et al., Tetrahedron, vol. 20, 189 (1964).

Sharnin et al., I, J. Org. Chem. U.S.S.R., vol. 4, pp. 1558 to 1562 (1968).

Sharnin et al. II, J. Org. Chem. U.S.S.R., vol. 6, pp. 1039 to 1041 (1970).

*Primary Examiner*—Floyd D. Higel

[57] ABSTRACT

2,4,6,2',4',6'-Hexanitro-3,5,3',5'-tetrachloroazobenzene, a new, high melting explosive is prepared by the simultaneous nitration and oxidation of 3,5-dichloroaniline in strong or fuming sulfuric acid using fuming nitric acid or potassium nitrate as both oxidizing and nitrating agent. Under these conditions nitric acid or potassium nitrate is expected to be a nitrating agent only, and oxidation of the amino group is not expected.

5 Claims, No Drawings

HEXANITROTETRACHLOROAZOBENZENE AND METHOD OF PREPARATION

BACKGROUND OF THE INVENTION

1. Field of the Invention

This invention concerns the explosive compound, 2,4,6,2',4',6'-hexanitro-3,5,3',5'-tetrachloroazobenzene (I) and the preparation of this compound from 3,5-dichloroaniline (II).

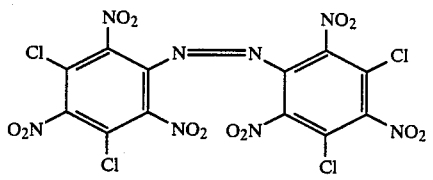

(I)

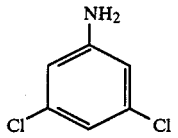

(II)

2. Background References

The following articles are cited as reference materials to the prior art of this invention:

(1) Flurscheim B and Holmes E. L.—Journal of Chemical Society, 3041 (1928). As quoted in Beilstein's Handbook of Organic Chemistry, Second Supplement, Vol. 12, 428.

(2) Nielsen A. T., Atkins R. L. and Norris W. P.—Journal of Organic Chemistry, Vol. 44, 1181 (1979).

(3) Nielsen A. T., Atkins R. L., Norris W. P., Coon C. L., and Sitzmann M. E.—Journal of Organic Chemistry, Vol. 45, 2341 (1980).

(4) Atkins R. L., Nielsen A. T., Bergens C., and Wilson W. S.—Journal of Organic Chemistry, Vol. 49, 503 (1984).

(5) Atkins R. L., Nielsen A. T., and Norris W. P.-US 116,351, 29 Aug. 1980; Chemical Abstracts, Vol. 94, Abstract 33,126q (1981).

(6) Wheeler O. H. and Gonzalez D.-Tetrahedron, Vol. 20,189 (1964).

DESCRIPTION OF THE PRIOR ART

The prior art teaches that nitration of similar compounds, for example, 3,5-dinitroaniline (III) using fuming nitric acid in strong or fuming sulfuric acid leads to simple trinitration of the aromatic ring without oxidation of the amino group. Thus, 3,5-dinitroaniline (III) yields pentanitroaniline (IV) when nitrated according to the method of Flurscheim and Holmes (Reference 1). These results have been repeated and confirmed by Nielsen et.al. (References 2, 3, and 4).

Atkins et.al. (Reference 5) nitrated 4-amino-2,6-dinitrotoluene (V) under similar conditions and obtained pentanitroaniline (IV). This reaction involves removal of a methyl group while leaving intact the amino group.

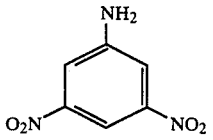

(III)

-continued

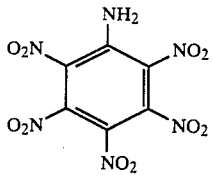

(IV)

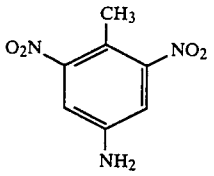

(V)

The oxidation of substituted anilines to azobenzenes is a well-known procedure; oxidizing agents of various sorts are employed. Wheeler and Gonzalez (Reference 6) used manganese dioxide as their oxidizing agent; with this reagent they oxidized 3,5-dichloroaniline (II) to the corresponding 3,5,3'5'-tetrachloroazobenzene (VI) in yields above 90%. Wheeler and Gonzalez report their technique gives only a 10% yield of azobenzene when applied to 3,5-dichloro-4-nitroaniline (VII).

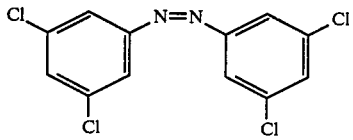

(VI)

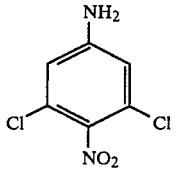

(VII)

SUMMARY OF THE INVENTION

According to this invention, the amino group of 3,5-dichloroaniline is selectively oxidized to an azo group in addition to the aromatic ring being trinitrated. This occurs in strong sulfuric acid with fuming nitric acid or potassium nitrate acting both as an oxidizing agent and as a nitrating agent. The product, hexanitrotetrachloroazobenzene, is itself a high temperature-resistant explosive; in addition, it is a useful intermediate in the making of other high temperature-resistant explosives.

DESCRIPTION OF THE PREFERRED METHODS

The method of this invention may be practiced by carrying out the procedures set forth in the following specific examples.

EXAMPLE 1

The acid nitration mixture is made up and cooled to 10° C.; it consists of 400 ml of 96% sulfuric acid, 28 ml of 90% fuming nitric acid and 41 gms. of 30% fuming sulfuric acid. Over a fifteen minute period, 10 gms. of powdered 3,5-dichloroaniline is added to this stirred acid mixture, keeping the reaction temperature below 10° C. After stirring for an additional fifteen minutes at 10° C., the reaction was slowly heated to 68°-76° C. and held there for one hour with constant stirring. The reaction, which now contains a tan foam, was cooled to 12° C., and quenched by pouring over 2 liters of chipped ice. The solid was filtered, washed with water and dried, yielding 12.3 gms. of a tan to orange solid (67% yield), melting at 281°-289° C. Recrystallization from acetone and hexane gave a fluffy orange solid melting at 308°-314° C.

EXAMPLE 2

The use of the fuming sulfuric acid is not mandatory. Thus, the acid nitration mixture consists of 400 ml of 96% sulfuric acid and 28 ml of 90% fuming nitric acid. This acid mixture is cooled to 10° C. and 10 gms. of powdered 3,5-dichloroaniline is added in small portions to this cold, stirred acid mixture. After the addition of the aniline is completed, the reaction mixture is warmed to 68° C. in 40 minutes. The stirred reaction mixture is kept between 68° C. and 80° C. for one hour, cooled to room temperature and quenched by pouring over 2 liters of chipped ice. The tan to orange solid is filtered, washed with about 500 ml of water and dried. The solid product amounts to 14.1 gms. (77% yield) and melts at 278°-290° C. Recrystallization from acetone and dichloroethane gave orange, fluffy solid, melting at 302°-314° C.

EXAMPLE 3

The aniline can be sulfonated by heating with the 96% sulfuric acid before adding the nitric acid; this procedure does not change the results. Thus, 400 ml of 96% sulfuric acid was cooled to 8° C. and to this stirred acid was added 10 gms. of powdered 3,5-dichloroaniline. The resulting slurry was stirred at 10° C. for 10 minutes and then it was heated to 80° C. for 30 minutes with stirring. After cooling the resulting grey solution to 8° C., the dropwise addition of 28 ml of 90% fuming nitric acid to the stirred reaction mixture was begun. This nitric acid addition is initially quite exothermic but the exotherm decreases as the addition of nitric acid proceeds. When the nitric acid addition was completed, the reaction mixture was stirred for 30 minutes in an ice bath, allowed to warm to room temperature over 30 minutes, then heated to 50° C. for 30 minutes—all with constant stirring. The stirred reaction mixture was then cooled to 15° C., quenched by pouring over 2 liters of chipped ice and filtered. After drying, the yield of tan solid was 13.0 gms. (71% yield); the solid melted at 275°-287° C. This tan solid was recrystallized from tetrahydrofuran and hexane to give a fluffy orange solid, melting at 309°-314° C.

EXAMPLE 4

The 90% fuming nitric acid can be replaced by potassium nitrate without significantly changing the results. Thus, 10 gms. of powdered 3,5-dichloroaniline was slowly added to 200 ml of 96% sulfuric acid at a temperature below 10° C. This stirred slurry was then heated for one hour at 86°-96° C., becoming a grey solution during this heating.

In a second flask, 61 gms. of potassium nitrate was dissolved in 200 ml of 96% sulfuric acid with slight warming and stirring. When the potassium nitrate had dissolved, 20 ml of 30% fuming sulfuric acid was added.

Both sulfuric acid solutions were cooled to 8° C. and the potassium nitrate solution was slowly added to the 3,5-dichloroaniline solution with stirring and cooling, keeping the temperature of the nitration mixture below 10° C. When the addition of the potassium nitrate solution was completed, the nitration mixture was stirred for 30 minutes at a temperature below 10° C., allowed to warm up to 20° C. in 30 minutes and finally heated to 70° C. for 10 minutes. The reaction mixture was then cooled in ice, quenched by pouring over 2 and one half liters of chipped ice. The solid was filtered, washed with water and dried. The yield of tan to brown solid was 13 gms. (71% yield) and it melted at 279°-287° C.

Analytical Data 2,4,6,2',4',6'-Hexanitro-3,5,3',5'-tetrachloroazobenzene has the formula: $C_{12}N_8O_{12}CL_4$, molecular weight 589.99.

Carbon-calculated 24.43%; found 24.64%
Hydrogen-calculated 0%; found 0.34%
Nitrogen-calculated 18.99%; found 17.98%
Chlorine-calculated 24.04%; found 24.66%
Mol. Wt.-calculated 590; found 540

We claim:

1. The compound 2,2',4,4',6,6'-hexanitro-3,3',5,5'-tetrachloroazobenzene.

2. The process of making the compound 2,2',4,4',6,6'-hexanitro-3,3',5,5'-tetrachloroazobenzene, said process consisting of adding 3,5-dichloroaniline to an acid nitration mixture consisting of sulfuric acid, fuming nitric acid, and fuming sulfuric acid at a temperature below room temperature and then heating the reaction mixture to an elevated temperature for a period of time ranging from a few minutes to several hours and finally cooling said reaction mixture, quenching it in ice and filtering off the product, said 2,2',4,4',6,6'-hexanitro-3,3',5,5'-tetrachloroazobenzene.

3. The process of claim 2 whereby the acid nitration mixture consists of sulfuric acid and fuming nitric acid alone.

4. The process of making the compound 2,2',4,4',6,6'-hexanitro-3,3',5,5'-tetrachloroazobenzene, said process consisting of adding 3,5-dichloroaniline to sulfuric acid and sulfonating said 3,5-dichloroaniline by heating the resulting solution to an elevated temperature for a period of time to effect sulfonation of said 3,5-dichloroaniline and continuing by cooling the said sulfonated 3,5-dichloroaniline solution below room temperature and then adding fuming nitric acid to the sulfonated 3,5-dichloroaniline solution followed by heating the resulting reaction mixture for a period of time ranging from a few minutes to several hours and finally cooling the said reaction mixture, quenching it in ice and filtering off the product, 2,2',4,4',6,6'-hexanitro-3,3',5,5'-tetrachloroazobenzene.

5. The process of claim 4 whereby the fuming nitric acid is replaced by a sulfuric acid solution of potassium nitrate.

* * * * *